US009476414B2

(12) United States Patent
Wallis

(10) Patent No.: US 9,476,414 B2
(45) Date of Patent: Oct. 25, 2016

(54) VARIABLE CAPACITY RECIPROCATING COMPRESSOR

(71) Applicant: Emerson Climate Technologies, Inc., Sidney, OH (US)

(72) Inventor: Frank S. Wallis, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 14/337,589

(22) Filed: Jul. 22, 2014

(65) Prior Publication Data

US 2015/0044066 A1 Feb. 12, 2015

Related U.S. Application Data

(60) Provisional application No. 61/863,550, filed on Aug. 8, 2013.

(51) Int. Cl.
*F04B 19/02* (2006.01)
*F04B 19/22* (2006.01)
(Continued)

(52) U.S. Cl.
CPC ..... *F04B 19/022* (2013.01); *F04B 7/02* (2013.01); *F04B 19/22* (2013.01); *F04B 39/0016* (2013.01); *F04B 39/122* (2013.01)

(58) Field of Classification Search
CPC .... F04B 19/022; F04B 19/22; F04B 39/122; F04B 39/0016; F04B 7/02; F04B 7/0003; F04B 7/0208; F04B 7/04; F04B 3/00; F04B 13/00; F04B 53/148
USPC ..... 417/251, 252, 256, 258–262, 289, 417/457–459, 490–491, 525–527
See application file for complete search history.

(56) References Cited

U.S. PATENT DOCUMENTS 3,145,660 A * 8/1964 Bush ..... F01B 11/08 123/46 R
4,749,337 A * 6/1988 Dickinson ..... F04B 53/126 417/199.1
5,885,061 A 3/1999 Olofsson et al.
6,733,257 B2 5/2004 Ryu

FOREIGN PATENT DOCUMENTS

JP 55093985 7/1980
KR 20030088533 A 11/2003
KR 20110025372 A 3/2011

OTHER PUBLICATIONS

International Search Report regarding Application No. PCT/US2014/049888, mailed Nov. 21, 2014.
(Continued)

*Primary Examiner* — William H Rodriguez
*Assistant Examiner* — Christopher Brunjes
(74) *Attorney, Agent, or Firm* — Harness, Dickey & Pierce, P.L.C.

(57) ABSTRACT

A reciprocating compressor may include a shell, a first cylinder, a plate, a second cylinder, and a piston. The first cylinder may be disposed within the shell and may include a first valve. The plate may be fixed relative to the first cylinder and may include a second valve. The second cylinder may be axially aligned with the first cylinder and may be moveable relative to the first cylinder between first and second positions. The piston may be disposed within the second cylinder and may include a third valve. The piston may reciprocate relative to the first and second cylinders. The piston and the plate may define a first compression chamber therebetween. The piston and the first cylinder may define a second compression chamber therebetween.

23 Claims, 6 Drawing Sheets

(51) Int. Cl.

| | |
|---|---|
| ***F04B 7/02*** | (2006.01) |
| ***F04B 39/00*** | (2006.01) |
| ***F04B 39/12*** | (2006.01) |

(56) References Cited

U.S. PATENT DOCUMENTS

| | | | | |
|---|---|---|---|---|
| 7,063,520 | B2 | 6/2006 | Oh et al. | |
| 2003/0206817 | A1* | 11/2003 | Oh | F04B 39/0016 417/417 |
| 2003/0210998 | A1* | 11/2003 | Ryu | F04B 39/0016 417/526 |
| 2011/0081254 | A1* | 4/2011 | Hafkemeyer | F04B 39/0207 417/13 |

OTHER PUBLICATIONS

Written Opinion of the International Searching Authority regarding Application No. PCT/US2014/049888, mailed Nov. 21, 2014.

* cited by examiner

VARIABLE CAPACITY RECIPROCATING COMPRESSOR

CROSS-REFERENCE TO RELATED APPLICATIONS

This application claims the benefit of U.S. Provisional Application No. 61/863,550, filed on Aug. 8, 2013. The entire disclosure of the above application is incorporated herein by reference.

FIELD

The present disclosure relates to a variable capacity reciprocating compressor.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a reciprocating compressor that may include a shell, a first cylinder, a plate, a second cylinder, and a piston. The first cylinder may be disposed within the shell and may include a first valve. The plate may be fixed relative to the first cylinder and may include a second valve. The second cylinder may be axially aligned with the first cylinder and may be moveable relative to the first cylinder between first and second positions. The piston may be disposed within the second cylinder and may include a third valve. The piston may reciprocate relative to the first and second cylinders. The piston and the plate may define a first compression chamber therebetween. The piston and the first cylinder may define a second compression chamber therebetween.

In some embodiments, the third valve may be movable between a first position restricting communication between the first and second compression chambers and a second position allowing communication between the first and second compression chambers.

In some embodiments, an inner diametric surface of the second cylinder may include an opening extending therethrough and communicating with an interior volume of the shell.

In some embodiments, the opening in the second cylinder may be isolated from the first compression chamber when the second cylinder is in the first position and may be allowed to communicate with the first compression chamber when the second cylinder is in the second position.

In some embodiments, motion of the piston toward the plate compresses fluid within the first compression chamber and forces fluid into the second compression chamber.

In some embodiments, fluid within the first compression chamber may be compressed therein to a first pressure when the second cylinder is in the first position and may be compressed therein to a second pressure when the second cylinder is in the second position. The second pressure may be lower than the first pressure.

In some embodiments, fluid may be compressed to a first discharge pressure in the second compression chamber when the second cylinder is in the first position and fluid is compressed to a second discharge pressure in the second compression chamber when the second cylinder is in the second position. The second discharge pressure may be lower than the first discharge pressure.

In some embodiments, the first cylinder may include a fluid-injection passage in communication with the second compression chamber.

In some embodiments, the reciprocating compressor may include a crankshaft driving the piston. The second cylinder may move between the first and second positions independently of motion of the crankshaft.

In another form, the present disclosure provides a reciprocating compressor operable in a full-capacity mode and in a reduced-capacity mode. The reciprocating compressor may include first and second cylinders and a piston. The second cylinder may at least partially surround the first cylinder and may be axially movable relative to the first cylinder between a first position corresponding to the full-capacity mode and a second position corresponding to the reduced-capacity mode. The piston may reciprocate within the second cylinder and may reciprocatingly receiving the first cylinder.

In some embodiments, the first cylinder and the piston may define a compression chamber therebetween.

In some embodiments, the first cylinder may include a fluid-injection passage in communication with the compression chamber.

In some embodiments, the reciprocating compressor may include a plate fixed relative to the first cylinder and cooperating with the piston and the second cylinder to define a first compression chamber. The piston and the first cylinder may cooperate to define a second compression chamber therebetween.

In some embodiments, the piston may include a first valve movable between a first position restricting communication between the first and second compression chambers and a second position allowing communication between the first and second compression chambers.

In some embodiments, the plate may include a second valve that may close to restrict fluid flow into the first compression chamber when the piston is moving toward the plate and may open to allow fluid flow into the first compression chamber when the piston is moving away from the plate.

In some embodiments, the first cylinder may include a third valve that closes to restrict fluid flow out of the second compression chamber when the piston is moving toward the plate and opens to allow fluid flow out of the second compression chamber when the piston is moving away from the plate.

In some embodiments, fluid within the first compression chamber may be compressed therein to a first pressure when the second cylinder is in the first position and may be compressed therein to a second pressure when the second cylinder is in the second position. The second pressure may be lower than the first pressure.

In some embodiments, an inner diametric surface of the second cylinder may include an opening extending therethrough.

In some embodiments, the opening in the second cylinder may be isolated from the first compression chamber when the second cylinder is in the first position. The opening may be allowed to communicate with the first compression chamber when the second cylinder is in the second position.

In some embodiments, the reciprocating compressor may include a crankshaft driving the piston. The second cylinder may move between the first and second positions independently of motion of the crankshaft.

In some embodiments, the piston may compress fluid to a first discharge pressure when the second cylinder is in the first position and the piston may compress fluid to a second discharge pressure when the second cylinder is in the second position. The second discharge pressure may be lower than the first discharge pressure.

In another form, the present disclosure provides a compressor including a compression mechanism that may include a piston and a cylinder defining a compression chamber therebetween. The piston may be movable within the cylinder in a first direction to draw working fluid into the compression chamber and movable within the cylinder in a second direction to compressor the working fluid in the compression chamber and discharge compressed working fluid from the compression chamber through a passage. The cylinder including an opening in selective communication with the compression chamber. The compression mechanism may be operable in a full-capacity mode in which communication between the compression chamber and the opening is restricted and in a reduced-capacity mode in which communication between the opening and the compression chamber is allowed during at least a portion of a duration of movement of the piston in the second direction.

In some embodiments, the compressor may include a shell containing the compression mechanism. In some embodiments, the shell may define a suction-pressure chamber in communication with the opening in the cylinder. In some embodiments, the cylinder may be movable relative to the shell between a first position allowing communication between the opening and the compression chamber and a second position restricting communication between the opening and the compression chamber.

In some embodiments, the compression mechanism may be a single-stage compression mechanism.

In some embodiments, the compression mechanism may be a multi-stage compression mechanism.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
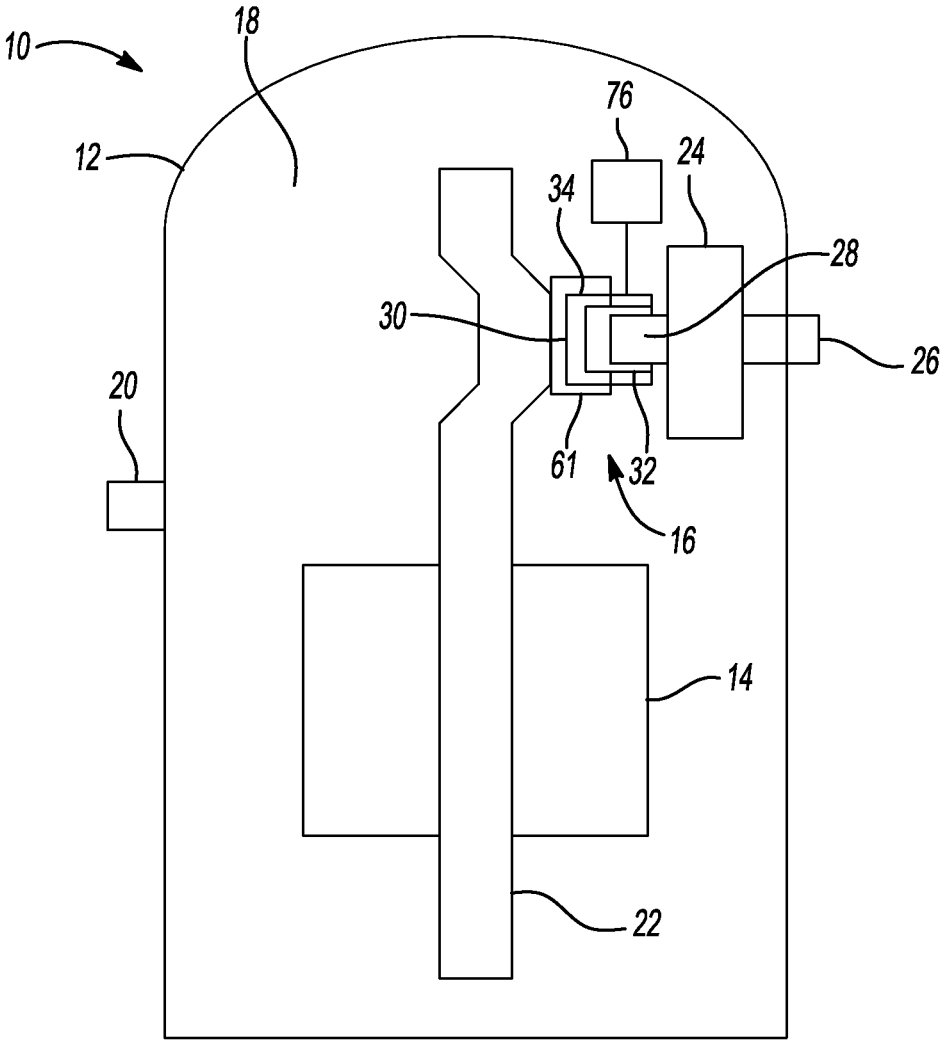
FIG. 1 is a schematic representation of a compressor including a compression mechanism according to the principles of the present disclosure.

Example embodiments will now be described more fully with reference to the accompanying drawings Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-7, a compressor 10 is provided that may include a shell 12, a motor assembly 14 and one or more compression mechanisms 16. The shell 12 may be a hermetic shell and may define an interior volume 18 that receives suction-pressure working fluid (e.g., refrigerant) through a suction inlet 20. The motor assembly 14 may be disposed within the shell 12 and may drivingly engage a crankshaft 22 that is operatively coupled to the compression mechanism 16. The compression mechanism 16 may draw in working fluid from the interior volume 18 and may discharge compressed working fluid into a discharge muffler 24 and subsequently out of the compressor 10 through a discharge outlet 26. As will be subsequently described, the compression mechanism 16 may be operable in a full-capacity mode and a reduced-capacity mode.

The compression mechanism 16 may include a first cylinder 28, a suction plate 30, a piston 32, and a second cylinder 34. The first cylinder 28 may be fixed relative to the discharge muffler 24 and the shell 12 and may include an outer diametrical surface 36, an inner diametrical surface 38, and an axial end wall 40. The inner diametrical surface 38 and axial end wall 40 may define a conduit 42 in fluid communication with the discharge muffler 24. The axial end wall 40 may include a discharge passage 44 extending therethrough and in selective communication with the conduit 42. A first valve member 46 may be movable relative to the axial end wall 40 between an open position (FIGS. 2 and 4) allowing fluid flow through the discharge passage 44 and a closed position (FIG. 3) restricting fluid flow through the discharge passage 44. The first valve member 46 can be any suitable type of valve. For example, in some embodiments, the first valve member 46 may be actuated by a difference in fluid pressures upstream and downstream of the discharge passage 44. In some embodiments, the first valve member 46 could be an electromechanically actuated valve, for example.

The suction plate 30 may be fixed relative to the first cylinder 28 and may be spaced apart and generally parallel to the axial end wall 40. The suction plate 30 may include an outer circumferential surface 48 and one or more suction passages 50. The circumferential surface 48 may slidably engage the second cylinder 34. In some embodiments, a piston ring (not shown) or other sealing member may sealingly engage the circumferential surface 48 and the second cylinder 34. One or more second valve members 52 may be movable relative to the suction plate 30 between an open position (FIGS. 2 and 4) allowing fluid flow through the suction passages 50 and a closed position (FIG. 3) restricting fluid flow through the suction passages 50. The second valve member 52 can be any suitable type of valve. For example, in some embodiments, the second valve member 52 may be actuated by a difference in fluid pressures upstream and downstream of the suction passages 50 (i.e., a fluid-pressure differential between the interior volume 18 and the first compression chamber 62. In some embodiments, the second valve member 52 could be an electromechanically actuated valve, for example.

The piston 32 may include a base portion 54 and a cup portion 56. The base portion 54 may be generally parallel to and disposed between the suction plate 30 and the axial end wall 40 of the first cylinder 28. A circumferential surface 58 of the base portion 54 may slidably engage the second cylinder 34. The cup portion 56 may extend in an axial direction from the base portion 54 and may reciprocatingly receive the first cylinder 28. An inner diametrical surface 60 of the cup portion 56 may slidably and sealingly engage the outer diametrical surface 36 of the first cylinder 28. One or more connecting rods 61 (FIG. 1) may couple the piston 32 to the crankshaft 22 so that rotation of the crankshaft 22 causes corresponding reciprocation of the piston 32 relative to the first and second cylinders 28, 34 and the suction plate 30.

The base portion 54 of the piston 32, the suction plate 30 and the second cylinder 34 may cooperate to define a first compression chamber 62. The base portion 54, the cup portion 56, and the axial end wall 40 of the first cylinder 28 may cooperate to define a second compression chamber 64. The base portion 54 may include one or more intermediate passages 66 and one or more third valve members 68 that are movable relative to the base portion 54 between an open position (FIG. 3) allowing fluid communication between the first and second compression chambers 62, 64 and a closed position (FIGS. 2 and 4) restricting fluid communication between the first and second compression chambers 62, 64. The third valve member 68 can be any suitable type of valve. For example, in some embodiments, the third valve member 68 may be actuated by a difference in fluid pressures upstream and downstream of the intermediate passages 66.

The second cylinder 34 may at least partially surround the first cylinder 28, the suction plate 30, and the piston 32 and may include one or more ports or openings 70 that extend radially through inner and outer diametrical surfaces 72, 74 of the second cylinder 34. The second cylinder 34 may be movable in an axial direction relative to the first cylinder 28, the suction plate 30, and the piston 32 between a first position (FIGS. 2-4) corresponding to the full-capacity mode and a second position (FIGS. 5-7) corresponding to the reduced-capacity mode. An actuator 76 (FIG. 1) may be coupled to the second cylinder 34 and may move the second cylinder 34 between the first and second positions. The actuator 76 could be or include any suitable type of actuator or motor, such as a solenoid or a stepper motor, for example, and may move the second cylinder 34 independently of the piston 32 and the crankshaft 22. A controller (not shown) may control operation of the actuator 76 based on compressor and/or system operating parameters, for example.

Figure 5:
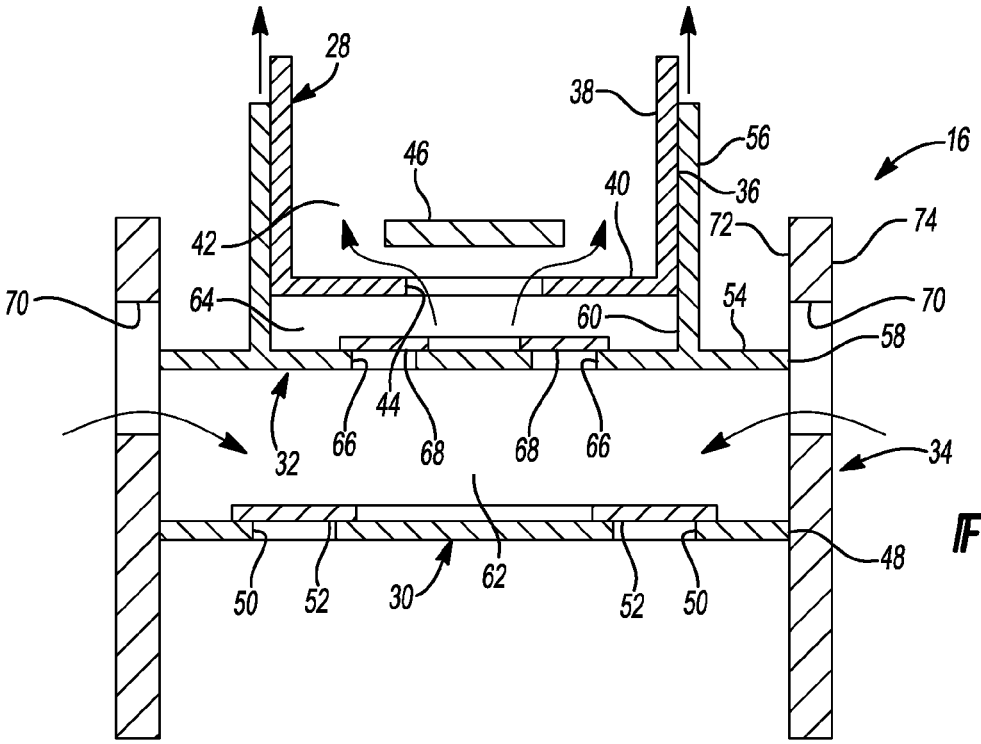
FIG. 5 is a schematic cross-sectional view of the piston-cylinder assembly in a reduced-capacity mode with the piston in a first position.
Figure 6:
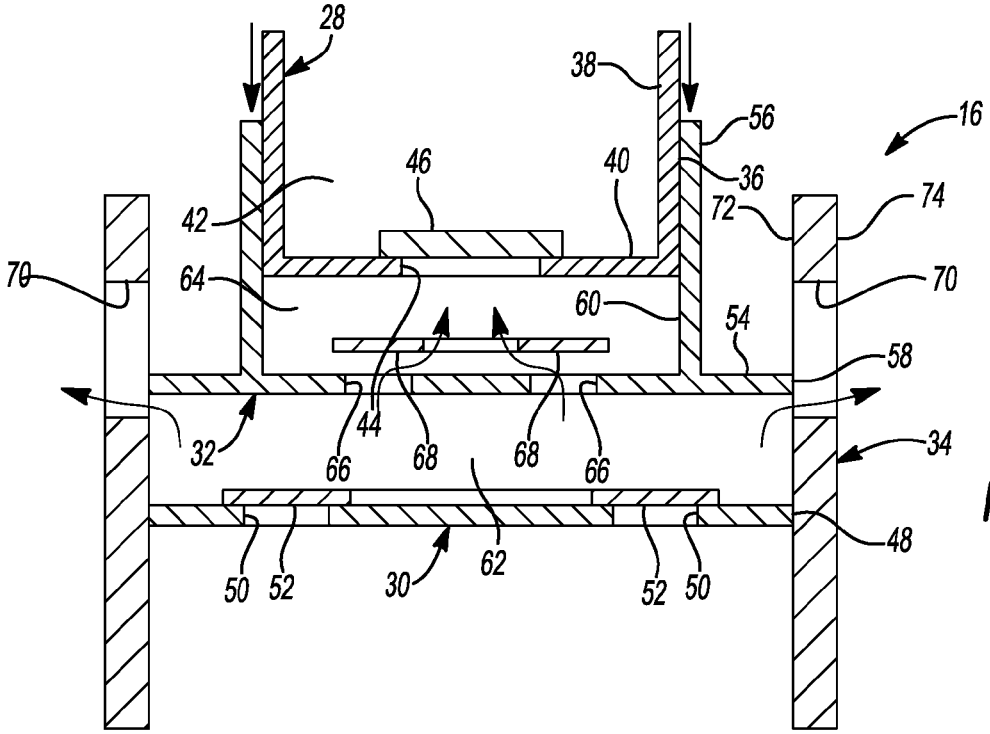
FIG. 6 is a schematic cross-sectional view of the piston-cylinder assembly in the reduced-capacity mode with the piston in a second position.
Figure 7:
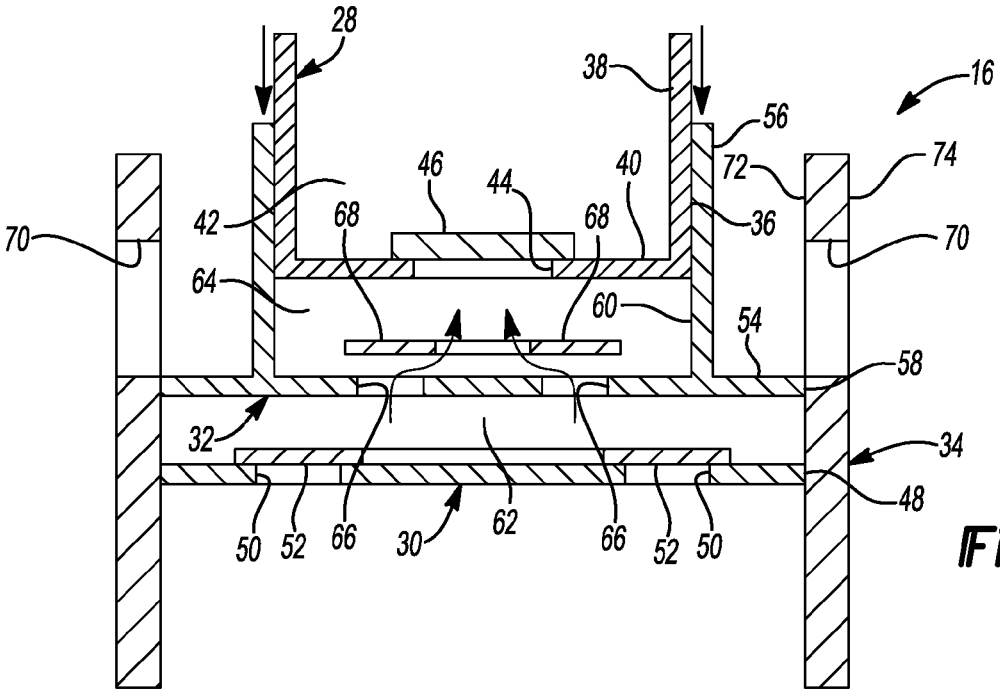
FIG. 7 is a schematic cross-sectional view of the piston-cylinder assembly in the reduced-capacity mode with the piston in a third position.

With continued reference to FIGS. 1-7, operation of the compressor 10 will be described in detail. As described above, the compression mechanism 16 may be operable in a full-capacity mode (FIGS. 2-4) and a reduced-capacity mode (FIGS. 5-7). In the full-capacity mode, the actuator 76 may position the second cylinder 34 such that the base portion 54 of the piston 32 remains between the suction plate 30 and the openings 70 in the second cylinder 34 during the entire reciprocation stroke of the piston 32 (i.e., travel of the piston 32 between a top-dead-center position (FIG. 2) and a bottom-dead-center position (FIG. 4)). That is, in the full-capacity mode, the second cylinder 34 is positioned so that the openings 70 are restricted or prevented from fluidly communicating with the first compression chamber 62 while the piston 32 is reciprocating. In the reduced-capacity mode, the actuator 76 may position the second cylinder 34 such that the base portion 54 of the piston 32 remains between the suction plate 30 and the openings 70 during, at most, only a portion of a reciprocation stroke of the piston 32. That is, in the reduced-capacity mode, the second cylinder 34 is positioned so that the openings 70 are able to fluidly communicate with the first compression chamber 62 during some or all of the reciprocation stroke of the piston 32.

Figure 2:
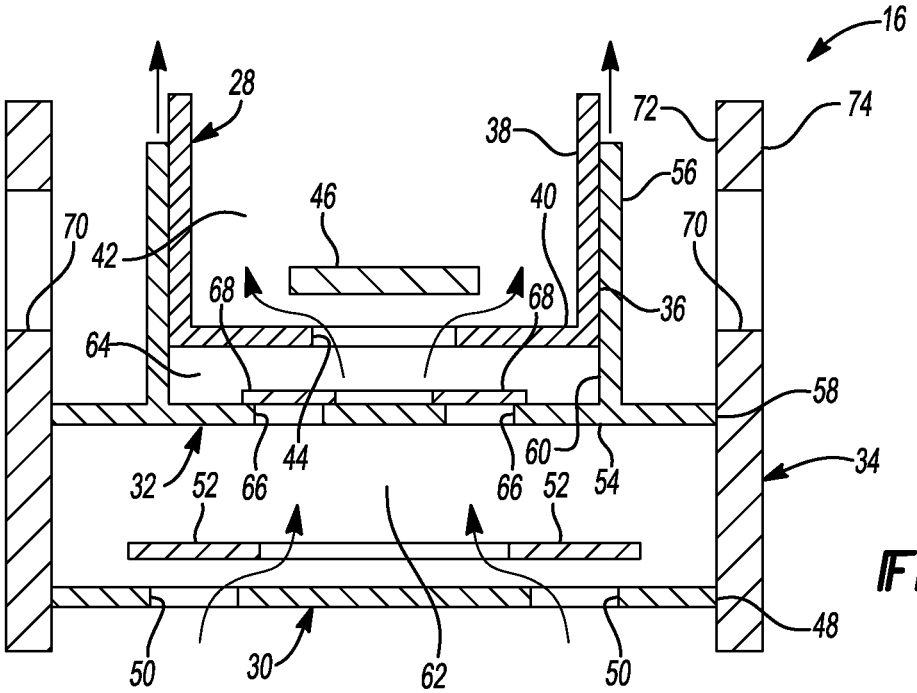
FIG. 2 is a schematic cross-sectional view of a piston-cylinder assembly of the compression mechanism of FIG. 1 in a full-capacity mode with a piston in a first position.

In the full-capacity mode, movement of the piston 32 away from the suction plate 30 (as shown in FIG. 2) may generate a pressure differential between the interior volume 18 and the first compression chamber 62 causing low-pressure working fluid from the interior volume 18 of the shell 12 to be drawn into the first compression chamber 62 through the suction passages 50. Meanwhile, such movement of the piston 32 toward the axial end wall 40 may compress working fluid within the second compression chamber 64 and force the working fluid out of the second compression chamber 64 and into the conduit 42 through the discharge passage 44. From the conduit 42, the compressed working fluid may flow into the discharge muffler 24 and out of the compressor 10 through the discharge outlet 26.

Figure 3:
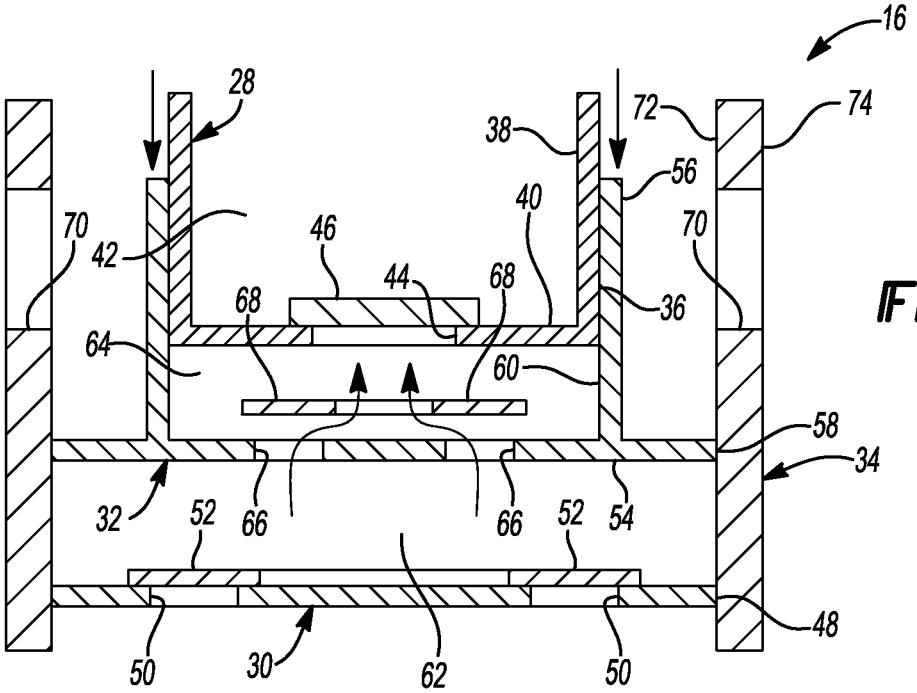
FIG. 3 is a schematic cross-sectional view of the piston-cylinder assembly in the full-capacity mode with the piston in a second position.
Figure 4:
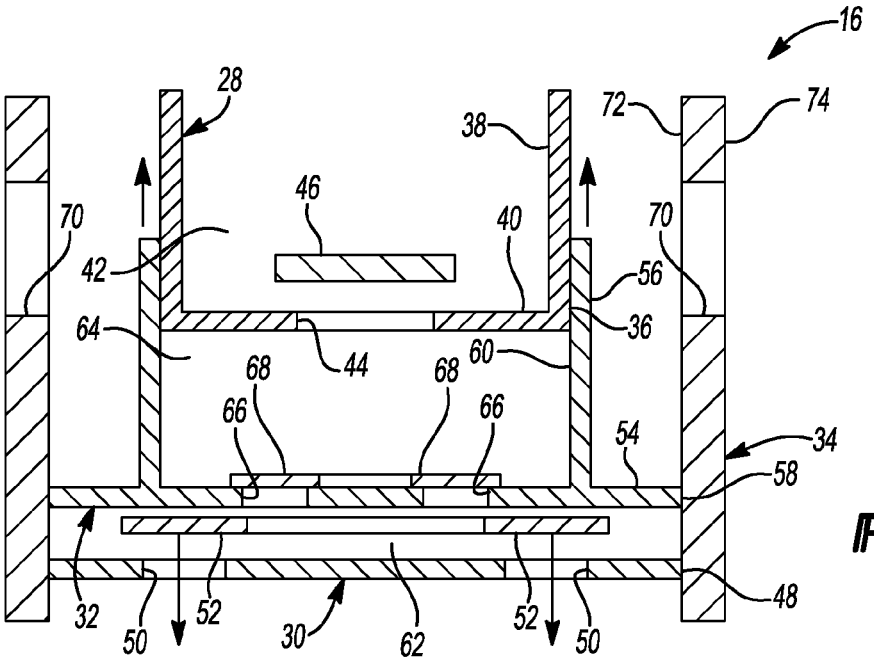
FIG. 4 is a schematic cross-sectional view of the piston-cylinder assembly in the full-capacity mode with the piston in a third position.

After reaching the top-dead-center position, the piston 32 moves back toward the suction plate 30 (as shown in FIG. 3), thereby compressing the working fluid in the first compression chamber 62, which generates a fluid-pressure differential between the interior volume 18 and the first compression chamber 62 that closes the second valve member 52 and generates another fluid-pressure differential between the first and second compression chambers 62, 64 that opens the third valve member 68 to allow working fluid to flow from the first compression chamber 62 into the second compression chamber 64. In this manner, in the full-capacity mode, the working fluid in the first compression chamber 62 is compressed to an intermediate pressure (while the piston 32 is moving toward the suction plate 30) before being drawn into the second compression chamber 64 for subsequent additional compression therein to a higher discharge pressure when the piston 32 moves back away from the suction plate 30.

In the reduced-capacity mode, the openings 70 are in fluid communication between the first compression chamber 62 for at least a portion of the stroke of the piston 32 so that working fluid within the first compression chamber 62 can leak to the interior volume 18. Therefore, the pressure of the fluid within the first compression chamber 62 may be substantially equal to the pressure of the fluid within the interior volume 18 (i.e., suction pressure) as long as the first compression chamber 62 is in communication with the openings 70. Therefore, in the reduced-capacity mode, the compression mechanism 16 may not begin to compress the working fluid until the base portion 54 of the piston 32 moves between the openings 70 and the suction plate 30 to seal off the first compression chamber 62 from the openings 70 (as shown in FIG. 7). Therefore, when compression of the fluid within the first compression chamber 62 occurs over only a portion of the stroke of the piston 32 (if at all), the pressure of the fluid entering the second compression chamber 64 will be lower than in the full-capacity mode. Therefore, the first valve member 46 will be forced open for a shorter duration (i.e., the first valve member 46 will be open for fewer degrees of crankshaft rotation than in the full-capacity mode) and less discharge-pressure working fluid will be discharged from the second compression chamber 64 into the conduit 42 in the reduced-capacity mode. In the reduced-capacity mode, the actuator 76 may position the second cylinder 34 at any desired position to achieve any desired amount of compression (or lack thereof) in the first compression chamber 62, which, in turn, controls the final capacity output of the compression mechanism 16.

Figure 8:
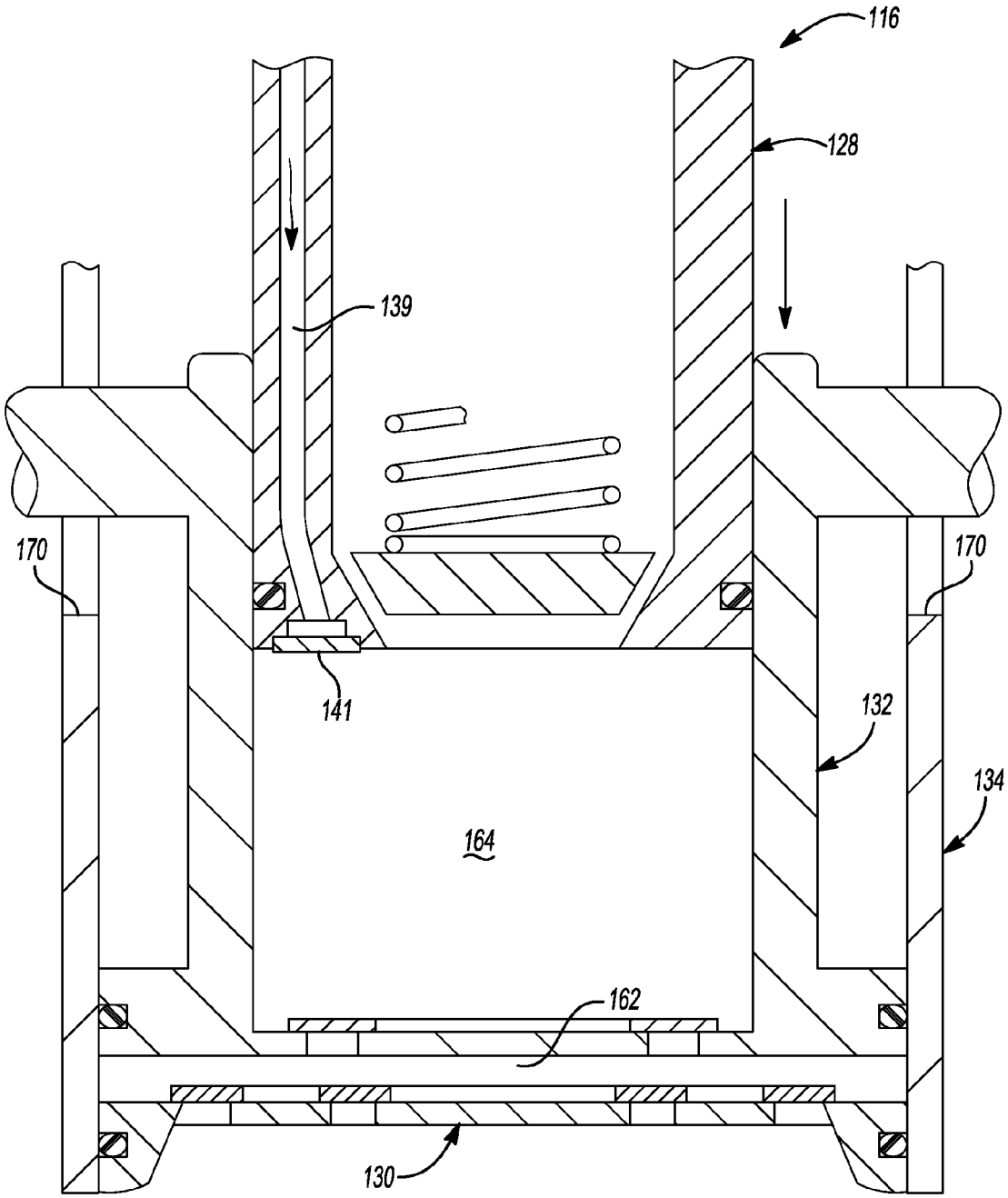
FIG. 8 is a schematic cross-sectional view of another piston-cylinder assembly having a fluid-injection passage.

With reference to FIG. 8, another compression mechanism 116 is provided that may include a first cylinder 128, a suction plate 130, a piston 132, and a second cylinder 134. The compression mechanism 116 may be incorporated into the compressor 10 in place of or in addition to the compression mechanism 16 and may be operable in a full-capacity mode and a reduced-capacity mode, as described above. The structure and function of the first cylinder 128, suction plate 130, piston 132, and second cylinder 134 may be similar or identical to that of the first cylinder 28, suction plate 30, piston 32, and second cylinder 34, respectively, described above, apart from any exceptions described below. As described above, the suction plate 130 and the piston 132 may cooperate to define a first compression chamber 162 therebetween, and the piston 132 and the first cylinder 128 may cooperate to define a second compression chamber 164 therebetween. The second cylinder 134 may be movable relative to the suction plate 130 to control communication between openings 170 in the second cylinder 134 and the first compression chamber 162, thereby controlling the capacity output of the compression mechanism 116.

The first cylinder 128 may include a vertically extending portion 138 having a fluid-injection passage 139 extending therethrough. A check valve 141 may be mounted to the first cylinder 128 and may be movable relative thereto between an open position allowing fluid to be injected into the second compression chamber 164 through the fluid-injection passage 139 and a closed position restricting fluid communication between the second compression chamber 164 and the fluid-injection passage 139. The fluid-injection passage 139 may receive intermediate-pressure working fluid from an economizer or vapor-injection circuit (not shown), a metered liquid refrigerant supply, and/or oil from an oil separator or sump, for example. Fluid may be injected into the second compression chamber 164 through the fluid-injection passage 139 when the compression mechanism 116 is in the full-capacity mode or in the reduced capacity mode. Injecting intermediate-pressure working fluid into the second compression chamber 164 when the compression mechanism 116 is in the full-capacity mode may result in a capacity output of greater than one-hundred percent.

Figure 9:
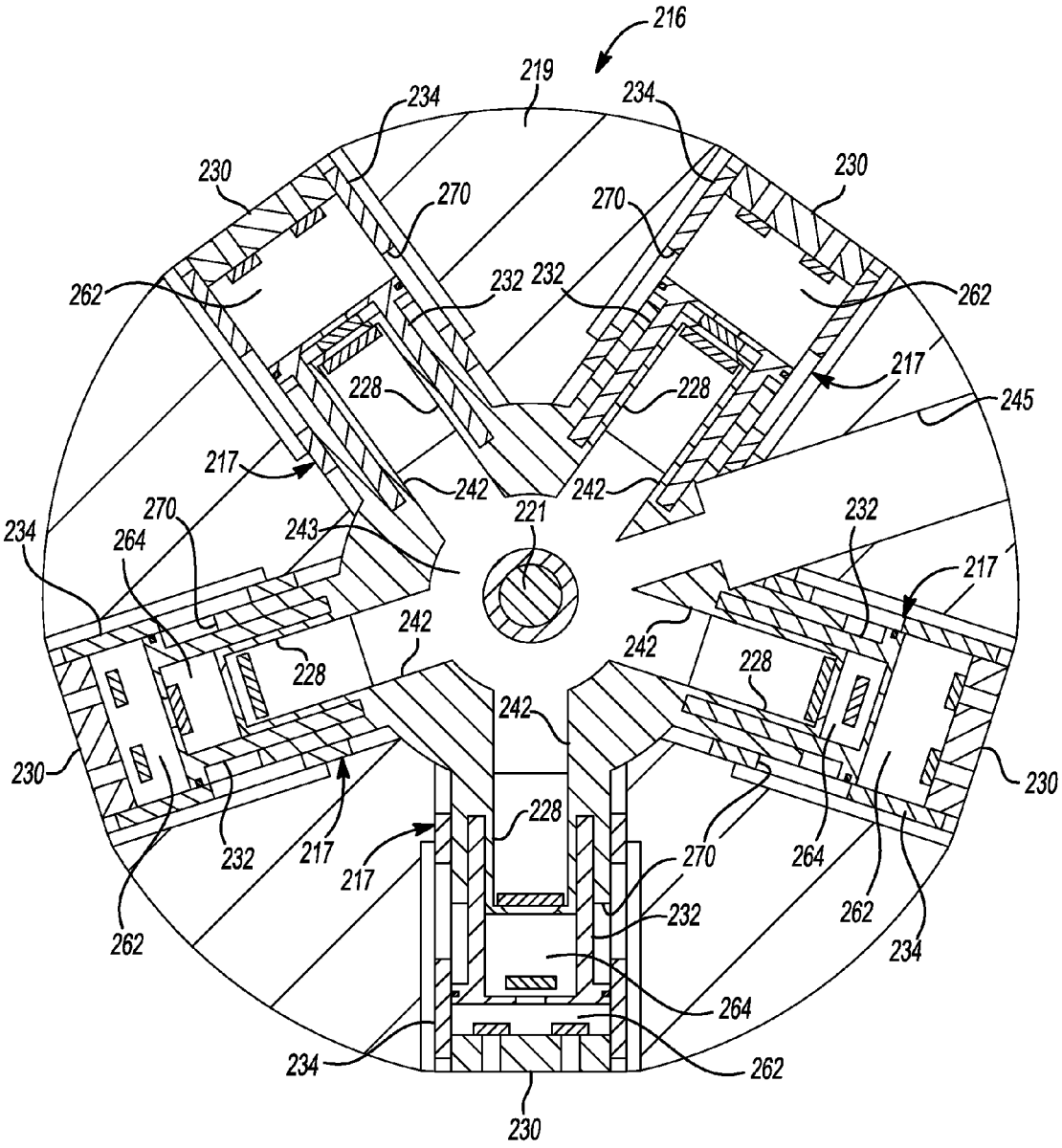
FIG. 9 is a schematic cross-sectional view of a compression mechanism having a plurality of piston-cylinder assemblies according to the principles of the present disclosure.

With reference to FIG. 9, another compression mechanism 216 is provided and may include a plurality of piston-cylinder assemblies 217 operable in a full-capacity mode and a reduced-capacity mode, as described above. Each of the piston-cylinder assemblies 217 may be disposed within a common body 219 and may include a first cylinder 228, a suction plate 230, a piston 232, and a second cylinder 234. The structure and function of the first cylinder 228, suction plate 230, piston 232, and second cylinder 234 may be generally similar to that of the first cylinder 28, suction plate 30, piston 32, and second cylinder 34, and therefore, will not be described again in detail. The compression mechanism 216 may be incorporated into the compressor 10, for example.

The first cylinders 228 may be integrally formed with the body 219 and each may include a conduit 242 in communication with a common manifold 243 formed in the body 219. The manifold 243 may include an outlet 245 in communication with a discharge muffler (not shown) and/or an outlet (not shown) of the compressor. The body 219 may be fixed relative to the shell 12.

As described above, the suction plate 230 and the piston 232 may cooperate to define a first compression chamber 262 therebetween, and the piston 232 and the first cylinder 228 may cooperate to define a second compression chamber 264 therebetween. The pistons 232 may be driven by a common crankshaft 221. As described above, the second cylinder 234 may be movable relative to the suction plate 230 to control communication between openings 270 in the second cylinder 234 and the first compression chamber 262, thereby controlling the capacity output of the compression mechanism 216.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A reciprocating compressor comprising:

a shell;

a first cylinder disposed within said shell and including a first valve that is movable relative to said first cylinder;

a plate fixed relative to said first cylinder and including a second valve that is movable relative to said plate;

a second cylinder axially aligned with said first cylinder and moveable relative to said first cylinder between first and second positions; and a piston disposed within said second cylinder and including a third valve that is movable relative to said piston, said piston reciprocating relative to said first and second cylinders, said piston and said plate defining a first compression chamber therebetween, said piston and said first cylinder defining a second compression chamber therebetween, wherein motion of said piston toward said plate compresses fluid within said first compression chamber and forces the compressed fluid out of said first compression chamber and into said second compression chamber without exiting said shell.

2. The reciprocating compressor of claim 1, wherein said third valve is movable between a first position restricting communication between said first and second compression chambers and a second position allowing communication between said first and second compression chambers.

3. The reciprocating compressor of claim 1, wherein an inner diametric surface of said second cylinder includes an opening extending therethrough and communicating with an interior volume of said shell.

4. The reciprocating compressor of claim 3, wherein said opening in said second cylinder is isolated from said first compression chamber when said second cylinder is in said first position and is allowed to communicate with said first compression chamber when said second cylinder is in said second position.

5. The reciprocating compressor of claim 1, wherein fluid within said first compression chamber is compressed therein to a first pressure when said second cylinder is in said first position and is compressed therein to a second pressure when said second cylinder is in said second position, said second pressure being lower than said first pressure.

6. The reciprocating compressor of claim 1, wherein fluid is compressed to a first discharge pressure in said second compression chamber when said second cylinder is in said first position and fluid is compressed to a second discharge pressure in said second compression chamber when said second cylinder is in said second position, said second discharge pressure being lower than said first discharge pressure.

7. The reciprocating compressor of claim 1, wherein said first cylinder includes a fluid-injection passage in communication with said second compression chamber.

8. The reciprocating compressor of claim 1, further comprising a crankshaft driving said piston, said second cylinder moving between said first and second positions independently of motion of said crankshaft.

9. The reciprocating compressor of claim 1, wherein an inner diametrical surface of the piston slidably and sealingly engages an outer diametrical surface of the first cylinder.

10. A reciprocating compressor operable in a full-capacity mode and in a reduced-capacity mode and including a first cylinder, a second cylinder at least partially surrounding said first cylinder and axially movable relative to said first cylinder between a first position corresponding to the full-capacity mode and a second position corresponding to the reduced-capacity mode, and a piston reciprocating within said second cylinder and reciprocatingly receiving said first cylinder, said piston defining a first compression chamber and a second compression chamber, wherein motion of said piston compressing fluid within said first compression chamber forces the compressed fluid out of said first compression chamber and into said second compression chamber without exiting the compressor.

11. The reciprocating compressor of claim 10, wherein said first cylinder and said piston define a compression chamber therebetween.

12. The reciprocating compressor of claim 11, wherein said first cylinder includes a fluid-injection passage in communication with said second compression chamber.

13. The reciprocating compressor of claim 10, further comprising a plate fixed relative to said first cylinder and cooperating with said piston and said second cylinder to define a first compression chamber.

14. The reciprocating compressor of claim 13, wherein said piston and said first cylinder cooperate to define a second compression chamber therebetween.

15. The reciprocating compressor of claim 14, wherein said piston includes a first valve movable between a first position restricting communication between said first and second compression chambers and a second position allowing communication between said first and second compression chambers.

16. The reciprocating compressor of claim 15, wherein said plate includes a second valve that closes to restrict fluid flow into said first compression chamber when said piston is moving toward said plate and opens to allow fluid flow into said first compression chamber when said piston is moving away from said plate.

17. The reciprocating compressor of claim 16, wherein said first cylinder includes a third valve that closes to restrict fluid flow out of said second compression chamber when said piston is moving toward said plate and opens to allow fluid flow out of said second compression chamber when said piston is moving away from said plate.

18. The reciprocating compressor of claim 17, wherein fluid within said first compression chamber is compressed therein to a first pressure when said second cylinder is in said first position and is compressed therein to a second pressure when said second cylinder is in said second position, said second pressure being lower than said first pressure.

19. The reciprocating compressor of claim 10, wherein an inner diametric surface of said second cylinder includes an opening extending therethrough.

20. The reciprocating compressor of claim 19, wherein said opening in said second cylinder is isolated from said first compression chamber when said second cylinder is in said first position and is allowed to communicate with said first compression chamber when said second cylinder is in said second position.

21. The reciprocating compressor of claim 10, wherein said piston compresses fluid to a first discharge pressure when said second cylinder is in said first position and said piston compresses fluid to a second discharge pressure when said second cylinder is in said second position, said second discharge pressure being lower than said first discharge pressure.

22. A compressor including a compression mechanism having a piston, a first cylinder and a second cylinder, said piston and said second cylinder defining a first compression chamber therebetween, said piston being movable within said cylinder in a first direction to draw working fluid into said first compression chamber and movable within said second cylinder in a second direction to compressor said working fluid in said compression chamber and discharge compressed working fluid from said compression chamber through a passage in said piston, said second cylinder including an opening in selective communication with said compression chamber, said compression mechanism being operable in a full-capacity mode in which communication between said first compression chamber and said opening is restricted and in a reduced-capacity mode in which communication between said opening and said compression chamber is allowed during at least a portion of a duration of movement of said piston in said second direction, wherein at least a portion of said first cylinder is disposed within said piston and within said second cylinder, said piston and said portion of said first cylinder defining a second compression chamber in which compressed working fluid is received from said passage in a compressed condition and is further compressed, said portion of said first cylinder defining a discharge conduit through which said further compressed working fluid is received from the second compression chamber.

23. The compressor of claim 22, further comprising a shell containing said compression mechanism and defining a suction-pressure chamber in communication with said opening in said cylinder.

* * * * *